US005746124A

United States Patent [19]

Kayser

[11] Patent Number: 5,746,124

[45] Date of Patent: May 5, 1998

[54] CALENDER FOR TREATING A WEB OF PAPER

[75] Inventor: Franz Kayser, Geldern, Germany

[73] Assignee: Voith Sulzer Finishing GmbH, Krefeld, Germany

[21] Appl. No.: 767,347

[22] Filed: Dec. 16, 1996

[30] Foreign Application Priority Data

Dec. 16, 1995 [DE] Germany ..... 195 47 164.4

[51] Int. Cl.[6] ..... D21G 1/02

[52] U.S. Cl. ..... 100/331; 100/155 R; 100/162 R; 162/206

[58] Field of Search ..... 100/155 R, 161–167, 100/327, 331; 162/205–207

[56] References Cited

U.S. PATENT DOCUMENTS

| | | | |
|---|---|---|---|
| 4,166,758 | 9/1979 | Watanabe et al. . | |
| 4,216,055 | 8/1980 | Watanabe et al. | 162/206 |
| 4,257,843 | 3/1981 | Watanabe et al. . | |
| 5,200,258 | 4/1993 | Tamagawa et al. | 162/206 |
| 5,237,915 | 8/1993 | Rounsley . | |
| 5,251,551 | 10/1993 | Abe et al. | 100/331 |
| 5,252,185 | 10/1993 | Ellis et al. | 100/331 |
| 5,609,098 | 3/1997 | Abe et al. | 100/331 |

FOREIGN PATENT DOCUMENTS

| | | | |
|---|---|---|---|
| 0 732 443 A | 9/1996 | European Pat. Off. . | |
| 295 04 034 | 6/1995 | Germany . | |
| 1-250493 | 10/1989 | Japan | 100/155 R |
| 2-14093 | 1/1990 | Japan | 100/161 |
| 5-279984 | 10/1993 | Japan | 100/155 R |

OTHER PUBLICATIONS

"Die neuen Superkalanderkonzepte", Voith Sulzer Papiertechnik, 1994, No. 05/94 d.

*Primary Examiner*—Stephen F. Gerrity
*Attorney, Agent, or Firm*—Darby & Darby

[57] ABSTRACT

A calender for treating a web of paper includes a stack of hard rollers and soft rollers. The stack includes a first set of processing nips and a second set of processing nips. Each processing nip is formed by a juncture of one of the hard rollers and one of the soft rollers. One side of the web of paper contacts against the hard rollers in the first set of processing nips and contacts against the soft rollers in the second set of processing nips. At least a last soft roller in the stack, which delimits a last processing nip that the web of paper passes through in the calender, has a lower surface roughness $R_a$ than a surface roughness $R_a$ of at least a first soft roller in the stack. The first soft roller delimits a first processing nip that the web of paper passes through in the calender. The surface roughness R. of the last soft roller is less than 0.35 μm.

23 Claims, 1 Drawing Sheet

Fig. 1
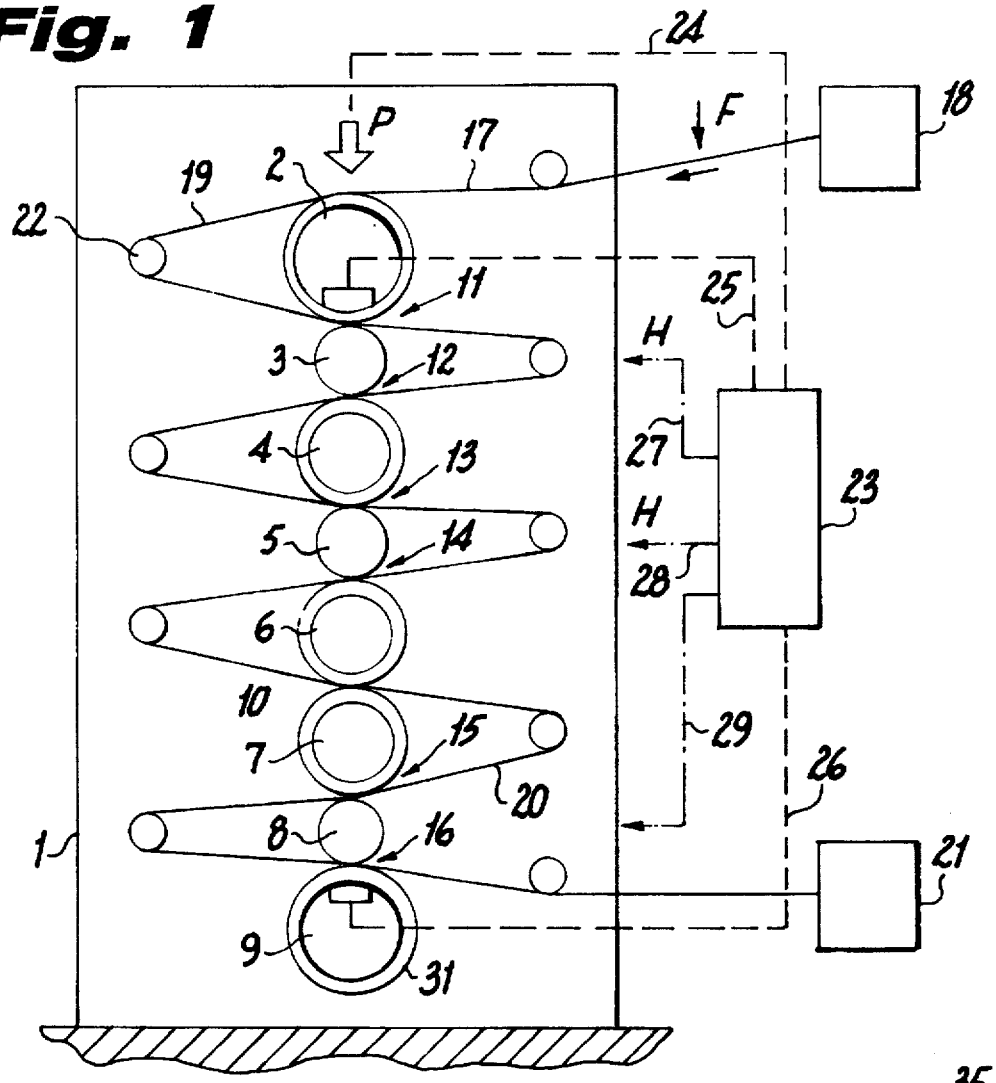
Fig. 2
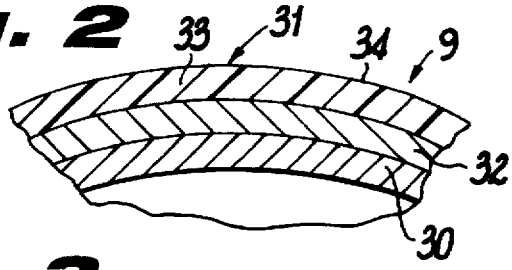
Fig. 3
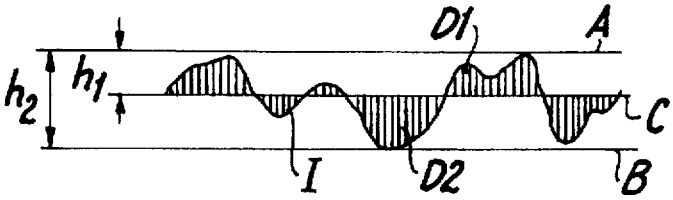
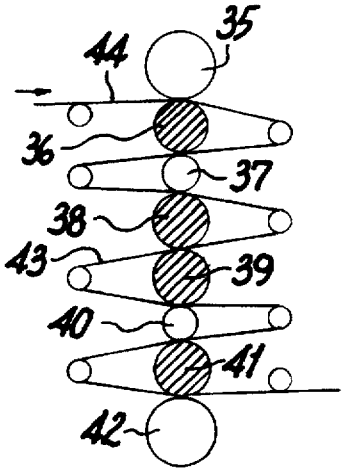
Fig. 4

CALENDER FOR TREATING A WEB OF PAPER

BACKGROUND OF THE INVENTION

1. Field of the Invention

The present invention relates to a calender for treating a continuous web of paper. The web of paper successively passes through a first and a second set of processing nips. Each processing nip is formed by the juncture of a hard roller and a soft roller. One side of the web contacts against the hard rollers in the first set of processing nips and then contacts against the soft rollers in the second set of processing nips.

2. Discussion of the Related Art

Calenders for treating a web of paper are well known. Attempts have been made to glaze or highly smooth both sides of the web of paper by first elastically pressing one surface against the smooth, hard rollers, while in the first set of processing nips and then elastically pressing the opposite surface against the hard rollers while in the second set of processing nips. A calender is typically provided with a stack of rollers that has a changeover nip disposed between the first and second set of processing nips. Alternatively, the calender can include two or more successive stacks of rollers, through which the web of paper is passed (see, for example, the calender disclosed in German reference DE-U-295 04 034). It has been difficult to obtain approximately identical degrees of gloss and/or smoothness on both sides of the web of paper in these prior art calenders. This is particularly true if, the compressive force in the lowermost processing nip is above 45 N/mm$^2$, the surface temperature of the heatable hard rollers is at least 212° F. (100° C.) and/or the moisture level of the web of paper is 5% or more. These parameters are typically used to reduce the number of calender rollers.

Accordingly, it is an object of the present invention to provide a calender that obtains approximately identical, high levels of gloss or smoothness on both sides of the web of paper especially when the compressive force in the lowermost processing nip is above 45 N/mm$^2$, the surface temperature of the heatable hard rollers is at least 212° F. (100° C.) and/or the moisture level of the web of paper is 5% or more.

SUMMARY OF THE INVENTION

The object of the present invention is achieved by providing a calender that has at least the lowermost soft roller (i.e., the soft roller that, in part with an adjacent hard roller, delimits the lowermost processing nip) having a lower surface roughness value than at least one of the soft rollers that delimit the uppermost processing nip (i.e., the first nip that the paper web passes through). The surface roughness value $R_a$ of the lowermost soft roller is less than 0.35 μm.

The present inventor has surprisingly discovered that the surface of the soft roller not only presses the opposite side of the web of paper against the hard roller for glazing and smoothing purposes, and also, perhaps, promotes the glazing and smoothing effect due to a microslippage between the soft roller and the web of paper, but, in fact, the surface properties of the soft roller have a similar effect on the paper web that the surfaces of the hard rollers do. This is especially true when the paper is more easily deformable because it is subject to higher temperatures, higher compressive loads and/or higher moisture levels.

Conventional soft rollers typically have a surface roughness $R_a$ of at least 0.5 μm. If this roughness profile is allowed to bear on the paper in the second set of processing nips, the gloss or smoothness values obtained in the first set of processing nips by means of contact against the hard rollers are reduced. But when the soft rollers in the second set of processing nips have a surface roughness $R_a$ of less than 0.35 μm, the gloss or smoothness values obtained in the first processing nips are not reduced. In fact, the use of smoother soft rollers in the second set of processing nips even helps to correct or restore these values if they were previously negatively affected by a rough plastic coating (i.e., from contacting against a conventional soft roller). Therefore, according to the present invention, at least the last soft roller of the last processing nip has a relatively low level of surface roughness. Of course, such a fine surface finish on the soft roller increases the cost to manufacture the soft roller. Therefore, where the surface roughness does not matter (e.g., in the first set of processing nips), it is acceptable to use a conventional soft roller, which has a surface roughness $R_a$ of $\geqq 0.5$ μm.

Each of the soft rollers delimiting the second set of processing nips preferably has a surface roughness $R_a$ of $<0.35$ μm. Thus, a reduction in the gloss and smoothness values that are obtained on one side of the web of paper in the first set of processing nips can be avoided.

The effect of restoring or maintaining the gloss or smoothness values can be even better achieved if the low level of surface roughness is further reduced to a surface roughness value $R_a$ of between 0.2 to 0.3 μm.

The surface roughness $R_a$ is the mean coefficient of roughness. In other words, the surface roughness $R_a$ is the arithmetic mean value of the absolute sums of the distances of the actual profile of the roller surface as measured from an average or center profile of the roller surface. The surfaces of the soft, low-roughness rollers preferably have an average peak-to-valley height $R_a$ of less than 2.5 μm. The average peak-to-valley-height is the arithmetic mean value of the individual peak-to-valley heights of five contiguous, individual measuring sections into which a roughness reference segment is subdivided. Typically, a conventional soft roller will have an average peak to valley height $R_a$ of 4.5 to 5.0 μm.

In one embodiment of the present invention, each of the soft rollers that form the first set of processing nips preferably has a higher surface roughness level than the last soft roller so that optimum results in smoothness and gloss values are obtained at minimum processing costs.

In the last processing nip, the ratio of the surface roughness $R_a$ of the last soft roller to that of the last hard roller is preferably less than 7. While it is practically impossible to make the surface roughness of the soft rollers match that of the hard rollers, the lowest possible ratio should preferably be achieved.

The last hard roller preferably has a surface roughness $R_a$ in the range from 0.04 to 0.051 μm so that a particularly high level of gloss and smoothness can be achieved in the treated web of paper.

The last hard roller preferably has a surface layer of a wear-resistant material, such as, for example, tungsten carbide. A tungsten carbide surface layer can be produced so that it has a very smooth finish. Additionally, because of the wear resistance of tungsten carbide, a doctor blade can be applied to the surface of the hard roller without compromising the surface quality of the roller.

All of the soft rollers that have a surface roughness of less than 0.35 μm preferably have an elastic cover that is made of a plastic material. The elastic cover is preferably made of a fiber-reinforced plastic base layer and a fiber-reinforced plastic outer layer. The base layer provides elasticity and the outer layer provides a high level of smoothness.

All of the soft rollers that have the relatively low surface roughness (i.e., $R_a$ <0.35 μm) have a cover that is made of a plastic material of such resiliency that when a fault in the paper web of up to 1 mm passes through a processing nip corresponding to the soft roller, the depth of a remaining impression in the roller surface will not exceed a maximum of 5% of the thickness of the fault. The high level of surface smoothness restored or maintained by the use of the soft rollers will not be lost even when faults in the web of paper are encountered because the soft roller has this relatively high degree of resiliency.

The first and second set of processing nips are preferably disposed in a substantially vertical stack. The web of paper passes through the stack from top to bottom. The first and second set of processing nips are separated from one another by a changeover nip, which is formed by the juncture of two soft rollers. In a roller stack of this type, the two lowermost rollers used in the second set of processing nips are under a particularly heavy load due to the weight of the rollers disposed above them. Correspondingly, the compression force in the second set of processing nips will be relatively high. Thus, a low level of surface roughness for the last soft roller is particularly desirable. This is especially true when the last soft roller of the last (i.e., lowermost) processing nip is the lowermost roller of the stack. Using such a last soft roller will produce on one side of the web of paper a high level of gloss or smoothness similar to that produced by the hard roller on the opposite side of the web of paper. A particularly practical configuration for the roller stack includes eight rollers, with four processing nips in the first set of processing nips and two processing nips in the second set of processing nips. Thus, a very small number of rollers may be used. Two processing nips in the second set of processing nips is sufficient to obtain design gloss and smoothness values in the paper web because, as the paper web travels through the first four processing nips, the paper web undergoes a certain smoothing on its surface due to its contact with the soft rollers, even if these soft rollers have a surface roughness $R_a$ of ≧0.5 μm.

In an alternative embodiment of the present invention, the uppermost and lowermost rollers of the stack are heatable hard rollers. In this embodiment, the stack is comprised of eight rollers, and the changeover nip is preferably disposed in the middle of the stack.

When the calender according to the present invention is used to a treat a coated paper, nearly identical gloss values are achieved on both sides of the paper at a level of at least 75% on the Gardner scale. In fact, nearly identical gloss and smoothness value of over 80% on the Gardner scale have been achieved.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 1 is a schematic illustration of a calender according to the present invention;

FIG. 2 is a cross-sectional view through a portion of a soft roller;

FIG. 3 is a graphic illustration showing the surface roughness of the soft roller on an enlarged scale; and FIG. 4 is a schematic illustration of a second embodiment of a calender according to the present invention.

DETAILED DESCRIPTION OF A PREFERRED EMBODIMENT

Referring now to FIG. 1, a calender 1 that includes a substantially vertical stack of rollers is illustrated. The stack includes, from top to bottom, an uppermost soft roller 2, a heatable hard roller 3, a soft roller 4, a heatable hard roller 5, a soft roller 6, a soft roller 7, a heatable hard roller 8 and a lowermost soft roller 9. Guide rollers 22 guide a web of paper 17, in a conventional manner, through the calender.

The juncture of soft rollers 6 and 7 form a changeover nip 10, where the surface of the web of paper that is being treated changes from a first side to a second, opposite side. A first set of processing nips 11, 12, 13 and 14 are disposed above changeover nip 10. A continuous web of paper 17, which is dispensed from a feed roller 18 (in an off-line operation) or from a paper machine (in an on-line operation), initially passes through the first set of processing nips 11–14 to treat a first side 19 of the paper web (because this side contacts hard rollers 3 and 5). After the web of paper passes through the changeover nip 10, it passes through the second set of processing nips 15 and 16 to treat the opposite side 20 of the paper web 17 because side 20 now contacts hard roller 8. After the web of paper 17 exits from nip 16, it is fed to a take-up device 21.

A control unit 23, *inter alia*, regulates, via a signal transmission line 24, a pressure P that is exerted on the stack of rollers. Uppermost roller 2 and lowermost roller 9 are preferably adjustable load-deflection rollers. The level of deflection of rollers 2,9 can be modified by the control unit, via control lines 25 and 26, respectively. The amount of thermal energy H applied to each of the three heatable hard rollers 3, 5 and 8 is regulated through the aid of control lines 27, 28 and 29, respectively. If necessary, a humidifier (not shown) can be provided to moisten the paper web at a preselected moisture level F before the web enters into calender 1.

Hard rollers 3, 5 and 8 are preferably steel rollers that have an outer layer of tungsten carbide, which has a surface roughness $R_a$ of 0.04 to 0.05 μm and is extremely wear-resistant.

The lowermost soft roller 9 preferably has a hollow shell 30 that is covered with an elastic layer 31. Layer 31 is preferably comprised of a fiber-reinforced plastic base layer 32 and a fiber-reinforced plastic outer layer 33. Layer 33 provides a smooth outer surface 34 to layer 31. The fiber material is preferably a plastic material, such as, for example, an aramide fiber (e.g., Kevlar®). The outer plastic layer 33 is preferably made of an epoxy resin. The uppermost soft roller 2 is preferably manufactured in a manner similar to roller 9. Soft rollers 4, 6 and 7 are preferably designed in a manner similar to roller 9, except that instead of a hollow shell 30, a solid or filled core is preferably used. An example of an elastic outer layer 31 is "TopTec 4"™, which is commercially available from Scapa Kern of Wimpassing, Austria.

Lowermost soft roller 9, which delimits lowermost processing nip 16 and soft roller 7 have a surface roughness $R_a$ of <0.35 μm, and more preferably $R_a$ is between 0.2 and 0.3 μm.

As shown in FIG. 3, the surface roughness value is established as defined below. The actual profile of the surface of the roller is indicated by letter I in FIG. 3. A reference profile is indicated by letter A, and a base profile is indicated by letter B. A center profile C is selected so that the total combined volume of the area D1 that the actual profile I encompasses above the center profile C is equal to the total combined volume of the area D2 that the actual profile I encompasses below center profile C. The mean coefficient of 7 roughness $R_a$ is the arithmetic mean value of the absolute sums of the distances h1 of the actual profile I from the center profile C. In contrast, the average peak-to-valley height $R_z$ is the arithmetic mean value of the individual peak-to-valley heights (h2) of five contiguous, individual measuring sections into which a roughness reference segment is subdivided. On the outer surface 34 of soft roller 9 this average peak-to-valley height $R_z$ value should be <2.5 μm.

The upper soft elastic rollers 2, 4 and 6 need not have this high a level of surface quality. A conventional surface roughness $R_a$ of ≧0.5 μm is sufficient for the upper soft rollers. These surface roughness values are relatively easily achievable at relatively low cost by machining, for example, by grinding and polishing. However, to obtain a surface roughness $R_a$ of <0.35 μm with materials that are available today, farther processing will be required, for example, by leveling the outer surface using a counter-roller, which preferably has little slippage. The rollers should cover each other over their entire surface.

Referring now to FIG. 4, a calender that includes a stack of rollers according to a second embodiment of the present invention is illustrated. The stack of rollers includes an uppermost hard roller 35, a soft roller 36, a hard roller 37, a soft roller 38, a soft roller 39, a hard roller 40, a soft roller 41 and a lowermost hard roller 42. The changeover nip 43 is located between soft rollers 38 and 39. A paper web 44 first travels through a first set of processing nips that are disposed above changeover nip 43, and, thereafter, travels through a second set of processing nips that are disposed below changeover nip 43.

Numerous tests were run on treated paper webs 17 that passed through a calender where the lower two soft rollers had the relatively low coefficient of roughness $R_a$ of less than 0.35 μm. In all cases, high gloss values of nearly the same magnitude were obtained on both sides 19 and 20 of the web of paper 17. The gloss values ranged from 76 to 83% on the Gardner scale and the smoothness values were up to 2,500 on the Bekk scale depending on the weight of the paper, the compressive force applied in the processing nips, the temperature of the hard rollers, the dwell time in the processing nips and the moisture level of the paper.

The preferable average compressive force in the lowermost processing nip was determined to be more than 45 and up to 60 N/mm$^2$. Similarly, the preferable surface temperature of the hard rollers was determined to be between 212° F. (100° C.) and 302° F. (150° C.), and the preferable paper moisture level was determined to be about 5 to 7%. More preferred ranges were, for the compressive force between 50 and 55 N/mm$^2$, for the surface temperature between 230° F. (110° C.) and 257° F. (125° C.), and a moisture level of about 6%. The dwell time in the processing nips is preferably between 0.1 and 0.9 ms and more preferably between 0.2 and 0.5 ms.

The calender according to the present invention proved to be particularly well suited to treat coated paper having a weight preferably in the range from 100 to 150 g/m$^2$. The difference in the above preferred ranges was negligible whether the inside of the paper first met with the hard rollers or with the soft rollers.

To prove the superior performance of the calender design according to the present invention, a test was conducted with the calender according to FIG. 1, in which the soft roller 2 and soft roller 7 had a surface roughness $R_a$ of 0.5 μm, while the remaining soft rollers 4, 6 and 9 had a lower surface roughness $R_a$ of 0.3 μm. After the paper web passed through the fourth processing nip 14, it was looped out and measured. The top surface, which had been pressed against a hard roller four times had a gloss value of 81%, while the bottom surface, which so far had only contacted against soft rollers had a gloss of 74%. With the gloss values being in the 80/75% range, these values remained nearly unchanged after the changeover nip 10. After the paper web passed through second processing nip the gloss value of the surfaces of the paper web was already in the 75/80% range. In other words, by contacting against the relatively rough and, thus, dull soft roller, which has an $R_a$ of 0.5 μm, the smoothness value of the top surface had lost five percentage points. The bottom surface, after its first contact with heated hard roller 8, gained five percentage points in gloss value. After the paper web passed through the last processing nip 16, the final gloss was 82/82%. Thus, because the upper surface contacted against lowermost relatively smooth soft roller, the upper surface regained seven percentage points of gloss value.

This test necessarily leads to the conclusion that because of the contact between an already glossy paper side and a soft roller surface that had a roughness $R_a$ of less than or equal to 0.5 μm, five percentage points of gloss value can be lost. Even more percentage points can be lost when the glossy paper side contacts a soft roller surface twice. If, however, the glossy paper surface, which is produced in the first processing nips 11–14 by contacting against the hard rollers, thereafter contacts against only a relatively very smooth soft roller (at least in the last processing nip), it is now possible to obtain the desired gloss and smoothness properties on both sides of the paper. Thus, after passing through the changeover nip, the glossy surface of the paper should no longer contact against soft rollers that have a relatively high roughness level. At a minimum, the final finish is produced in the lowermost nip using a very smooth soft roller 31 so that any possible surface deterioration that may have occurred will be compensated for.

Having described the presently preferred exemplary embodiment of a calender for treating a web of paper in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A calender for treating a web of paper comprising:

a stack of hard rollers and soft rollers;

a first set of processing nips and a second set of processing nips, each processing nip being formed by a juncture of one of said hard rollers and one of said soft rollers;

whereby one side of said web of paper contacts against said hard rollers in said first set of processing nips and contacts against said soft rollers in said second set of processing nips, at least a last soft roller in said stack, which delimits a last processing nip that said web of paper passes through in said calender, has a lower surface roughness $R_a$ than a surface roughness $R_a$ of at least a first soft roller in said stack, where said first soft roller delimits a first processing nip that said web of paper passes through in said calender, and said surface roughness $R_a$ of said last soft roller is less than 0.35 μm.

2. The calender according to claim 1, wherein each of said soft rollers in said second set of processing nips has a surface roughness $R_a$ of less than 0.35 μm.

3. The calender according to claim 2, wherein each of said soft rollers in said second set of processing nips has a surface roughness $R_a$ of between 0.2 and 0.3 μm.

4. The calender according to claim 2, wherein each of said soft rollers of said second set of processing nips have an average roughness peak-to-valley height $R_z$ of less than 2.5 μm.

5. The calender according to claim 1, wherein each of said soft rollers in said first set of processing nips has a higher surface roughness level than said last soft roller.

6. The calender according to claim 5, wherein said web of paper, after passing through said last processing nip, has substantially identical gloss values on both sides of said web of paper of at least 75% on the Gardner scale.

7. The calender according to claim 6, wherein said web of paper is a coated paper.

8. The calender according to claim 7, wherein said gloss values on both sides of said web of paper is greater than 80% on the Gardner scale.

9. The calender according to claim 1, wherein in said last processing nip, the ratio between said surface roughness $R_a$ of said last soft roller to that of a last hard roller is less than 7.

10. The calender according to claim 9, wherein said last hard roller has a surface roughness $R_a$ in a range from 0.04 to 0.05 μm.

11. The calender according to claim 1, wherein a last hard roller has a surface layer of a wear-resistant material.

12. The calender according to claim 11, wherein said surface layer is made of tungsten carbide.

13. The calender according to claim 1, wherein said last soft roller has an elastic cover that is made of a plastic material.

14. The calender according to claim 13, wherein said elastic cover is made of a fiber-reinforced plastic base layer and a fiber-reinforced plastic outer layer.

15. The calender according to claim 13, wherein said last soft roller has a cover that is made of a plastic material of such resiliency that a depth of a remaining impression in said cover, after a fault in said web of paper of up to 1 mm passes through said last processing nip, is at most 5% of said thickness of said fault.

16. The calender according to claim 1, wherein said first set of processing nips and said second set of processing nips are disposed in a substantially vertical stack and are separated from one another by a changeover nip that is formed by the juncture of two soft rollers.

17. The calender according to claim 16, wherein said last soft roller is the lowermost roller of said stack.

18. The calender according to claim 17, wherein said stack is comprised of eight rollers and includes four processing nips in said first set of processing nips and two processing nips in said second set of processing nips.

19. The calender according to claim 16, wherein an uppermost and a lowermost roller of said stack are heatable hard rollers.

20. The calender according to claim 19, wherein said stack is comprised of eight rollers and said changeover nip is disposed in said middle of said stack.

21. The calender according to claim 1, wherein said web of paper, after passing through said last processing nip, has substantially identical gloss values on both sides of said web of paper of at least 75% on the Gardner scale.

22. The calender according to claim 21, wherein said web of paper is a coated paper.

23. The calender according to claim 21, wherein said gloss values on both sides of said web of paper is greater than 80% on the Gardner scale.

* * * * *